US008776564B2

(12) United States Patent
Shimanuki et al.

(10) Patent No.: US 8,776,564 B2
(45) Date of Patent: Jul. 15, 2014

(54) IMPACT TREATMENT METHOD FOR IMPROVING FATIGUE CHARACTERISTICS OF WELDED JOINT, IMPACT TREATMENT DEVICE FOR IMPROVING FATIGUE CHARACTERISTICS FOR SAME, AND WELDED STRUCTURE SUPERIOR IN FATIGUE RESISTANCE CHARACTERISTICS

(75) Inventors: Hiroshi Shimanuki, Tokyo (JP); Tetsuro Nose, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 418 days.

(21) Appl. No.: 12/737,510

(22) PCT Filed: Jul. 21, 2009

(86) PCT No.: PCT/JP2009/063317

§ 371 (c)(1),
(2), (4) Date: Jan. 19, 2011

(87) PCT Pub. No.: WO2010/013658

PCT Pub. Date: Feb. 4, 2010

(65) Prior Publication Data

US 2011/0123820 A1 May 26, 2011

(30) Foreign Application Priority Data

Jul. 28, 2008 (JP) ..... 2008-193867

(51) Int. Cl.
*C21D 7/06* (2006.01)
*B21D 17/04* (2006.01)

(52) U.S. Cl.
USPC ..... 72/53; 72/75

(58) Field of Classification Search
USPC ..... 72/53, 67, 75, 76, 112, 710; 29/90.01; 148/558; 228/112.1
See application file for complete search history.

(56) References Cited

U.S. PATENT DOCUMENTS 2,390,795 A * 12/1945 Kotowicz ..... 72/437
2,888,846 A * 6/1959 Peras ..... 72/406

(Continued)

FOREIGN PATENT DOCUMENTS

CA 2464172 10/2005
EP 1559796 8/2005

(Continued)

OTHER PUBLICATIONS

International Search Report dated Nov. 2, 2009 issued in corresponding PCT Application No. PCT/JP2009/063317.

(Continued)

*Primary Examiner* — Edward Tolan
(74) *Attorney, Agent, or Firm* — Kenyon & Kenyon LLP

(57) ABSTRACT

An impact treatment method for improving fatigue characteristics of a welded joint comprising pressing an impact pin against the surface of a base metal material near a toe of a weld bead and making it move relatively to the weld line direction to apply hammer peening treatment or ultrasonic impact treatment, characterized by using as the impact pin an impact pin having a tip curvature radius of ½ or less of a thickness of the metal material and between 2 to 10 mm and, on a surface of a base metal material up to a range where a distance from the toe of the weld bead to the center of the impact treatment position is within 2.5 times the tip curvature radius of the impact pin and where the impact pin does not contact the weld metal during impact treatment, applying hammer peening or ultrasonic impact treatment so as to cause by the impact pin residual plastic deformation where an impact dent has a groove depth of 0.1 to 2 mm, the tip curvature radius of the impact pin or less, and 1/10th or less of the thickness of the metal material and where the impact dent has a width of 1.5 to 15 mm and five times or more the groove depth.

1 Claim, 6 Drawing Sheets

(56) References Cited

U.S. PATENT DOCUMENTS

| | | | | |
|---|---|---|---|---|
| 5,813,592 | A * | 9/1998 | Midling et al. | 228/112.1 |
| 6,171,415 | B1 | 1/2001 | Statnikov | |
| 6,649,870 | B1 | 11/2003 | Barton et al. | |
| 6,676,004 | B1 * | 1/2004 | Trapp et al. | 228/2.1 |
| 6,926,970 | B2 * | 8/2005 | James et al. | 428/615 |
| 6,932,876 | B1 * | 8/2005 | Statnikov | 148/558 |
| 7,122,761 | B2 * | 10/2006 | Ditzel et al. | 219/121.64 |
| 2006/0138197 | A1 * | 6/2006 | Aota et al. | 228/112.1 |
| 2009/0218033 | A1 * | 9/2009 | Aota et al. | 156/73.5 |
| 2009/0283571 | A1 * | 11/2009 | Hasegawa et al. | 228/112.1 |

FOREIGN PATENT DOCUMENTS

| | | |
|---|---|---|
| JP | 2-152771 | 6/1990 |
| JP | 2004-130313 | 4/2004 |
| JP | 2004-130315 | 4/2004 |
| JP | 2004-149843 | 5/2004 |
| JP | 2005-298879 | 10/2005 |
| JP | 2006-167724 | 6/2006 |
| JP | 2006-175512 | 7/2006 |
| JP | 2006-312201 | 11/2006 |
| JP | 2006-320960 | 11/2006 |

OTHER PUBLICATIONS

Japan Road Association, "Fatigue in Steel Bridges", Maruzen Co., May 1997, and English translation of related part.

P.J. Haagensen and S.J. Maddox, IIW Recommendations on Post Weld Improvement of Steel and Aluminum Structures, XIII-1815-00, Revised Feb. 16, 2004.

* cited by examiner

IMPACT TREATMENT METHOD FOR IMPROVING FATIGUE CHARACTERISTICS OF WELDED JOINT, IMPACT TREATMENT DEVICE FOR IMPROVING FATIGUE CHARACTERISTICS FOR SAME, AND WELDED STRUCTURE SUPERIOR IN FATIGUE RESISTANCE CHARACTERISTICS

This application is a national stage application of International Application No. PCT/JP2009/063317, filed 21 Jul. 2009, which claims priority to Japanese Application No. 2008-193867, filed 28 Jul. 2008 which is incorporated by reference in its entirety.

TECHNICAL FIELD

The present invention relates to an impact treatment method for improving fatigue characteristics of a welded joint, an impact treatment device for improving fatigue characteristics of the same, and a welded structure superior in fatigue resistance characteristics. In particular, it relates to an impact treatment method for improving fatigue characteristics of a welded joint able to efficiently improve the fatigue characteristics of a welded joint, where occurrence of fatigue cracks becomes a problem, in metal members for structures subjected to repeated load used in buildings, ships, bridges, construction machines, industrial machines, offshore structures, automobiles, etc. and an impact treatment device for improving fatigue characteristics of the same and a welded structure superior in fatigue resistance characteristics

BACKGROUND ART

Metal structures such as ships, bridges, construction machines, industrial machines, offshore structures, and automobiles are made by welding together many metal members. At these welded portions, welded joints are formed using various welding methods.

However, in such a welded joint, at the boundary part where the surface of the weld metal forming the weld bead intersects a surface of a metal member (base material) (referred to as the toe of the weld bead) and its vicinity (hereinafter referred to as the toe portion of the weld bead), tensile residual stress easily remains due to cooling in the state where the high temperature state weld metal is restrained by the surrounding base material. Furthermore, when used as a structure, this becomes a part where stress easily concentrates due to external force applied to the member.

Therefore, a welded joint used in a metal structure may suffer from fatigue cracks occurring from the toe portion of the weld bead and developing into critical cracks and fractures due to repeated load. Further, residual stress and stress concentration at the toe portion of the weld bead impedes improvement of fatigue characteristics of a metal structure.

Accordingly, fatigue cracks occurring in such a welded joint have a serious effect on the reliability of the entire structure, so a variety of methods for improving fatigue characteristics of welded joints have been attempted in the past. (For example, see Non-Patent Literatures 1 and 2.)

Specifically, the following Non-Patent Literatures 1 and 2 propose methods of reducing stress concentration at weld zones by (a) the method of using a mechanical method (grinding) to smooth the weld zone and (b) the method of using TIG welding to dress the weld zone.

Further, there is also proposed a method of treating the weld zone by peening (impact) to introduce compressive stress to portions where fatigue cracks occur and reduce stress concentration. As a specific impact treatment, (c) shot peening, (d) hammer peening, and also, in recent years, (e) ultrasonic impact treatment (for example, see Patent Literatures 1 to 3) may be mentioned.

Further, a method treating the vicinity of the weld toe portion by peening (impact) to improve the metal structure of the weld heat affected zone near the fusion line and improve the toughness of the heat affected zone is disclosed in Patent Literature 4. However, this is for improving the material quality at the starting point of brittle fracture based on brittle fractures generally forming from defects remaining on the fusion line of the weld zone and does not improve the fatigue characteristics.

Further, as methods for improving the fatigue characteristics of a welding toe portion at an end of a rib plate attached by welding, methods using a compression punch or the like to apply compressive residual stress to the welding toe portion (Patent Literatures 5 and 6) are disclosed, however, these methods both are methods for improving the fatigue characteristics at the end of a rib plate subjected to boxing etc. and cannot be applied to the part mainly covered by the present invention, that is, the welding toe portion which continues long in the weld line direction.

CITATION LIST

Patent Literature

PLT 1
Japanese Patent Publication (A) No. 2006-167724
PLT 2
Japanese Patent Publication (A) No. 2006-175512
PLT 3
U.S. Pat. No. 6,171,415
PLT 4
Japanese Patent Publication (A) No. 2004-149843
PLT 5
Japanese Patent Publication (A) No. 2006-320960
PLT 6
Japanese Patent Publication (A) No. 2006-312201

Non Patent Literature

Non-PLT 1
Japan Road Association, "Fatigue in Steel Bridges", Maruzen Co., May 1997
Non-PLT 2
P. J. Haagensen and S. J. Maddox, IIW Recommendations on Post Weld Improvement of Steel and Aluminum Structures, XIII-1815-00, Revised 16 Feb. 2004

SUMMARY OF INVENTION

It is known that according to the above (a) to (e) and other treatment for improving fatigue characteristics, it is possible to improve fatigue crack resistance characteristics at the toe portions of weld beads. Particularly, the above (e) ultrasonic impact treatment gives great effects of improvement by a relatively short time treatment, so is viewed as very promising in the industrial sector.

However, this ultrasonic impact treatment has been developed on the assumption that treatment will be performed manually, thus there has been cases where its adoption has been difficult such as in structures requiring continuous treatment over long distances such as in steel bridges and cranes and in factories and the like where assembly is becoming automated.

Further, when installing an ultrasonic impact treatment device in a robot to carry out automated treatment, since the line of the toe of a weld bead will normally deform irregularly, accurately carry out treatment on the toe portion of the weld bead requires a toe detection function, a running mechanism following the deformation, and other advanced automatic control. There have been cases where commercial utilization has been difficult from a cost perspective as well as a result.

Further, when applying direct impact treatment on the toe portion of a weld bead, it is necessary to use an impact pin matching the toe shape of the weld bead. Depending on the toe shape of the weld bead, the impact pin may catch on the weld metal of the toe portion, treatment may halt, or crease marks or sharp notch shaped defects may remain at the toe portion.

Therefore, the present invention was proposed taking into consideration these past situations and has as its object to provide an impact treatment method for improving fatigue characteristics of a welded joint enabling stable hammer peening treatment or ultrasonic impact treatment without being too affected by a complicated toe shape of a weld bead and enabling compressive residual stress to be applied to a larger portion in the vicinity of the toe of the weld bead and an impact treatment device for improving fatigue characteristics of the same and a welded structure superior in fatigue resistance characteristics.

The gist of the present invention having as its object to solve the above problems is as follows.

(1) An impact treatment method for improving fatigue characteristics of a welded joint comprising pressing an impact pin against the surface of a base metal material near a toe of a weld bead and making it move relatively to the weld line direction to apply hammer peening treatment or ultrasonic impact treatment, said impact treatment method for improving fatigue characteristics of a welded joint characterized by using as the impact pin an impact pin having a tip curvature radius of ½ or less of a thickness of the metal material and between 2 to 10 mm and, on a surface of the base metal material up to a range where a distance from the toe of the weld bead to the center of the impact treatment position is within 2.5 times the tip curvature radius of the impact pin and where the impact pin does not contact the weld metal during impact treatment, applying hammer peening or ultrasonic impact treatment so as to cause by the impact pin residual plastic deformation where an impact dent has a groove depth of 0.1 to 2 mm, the tip curvature radius of the impact pin or less, and 1/10th or less of the thickness of the metal material and where the impact dent has a width of 1.5 to 15 mm and five times or more the groove depth.

(2) An impact treatment device for improving the fatigue characteristics of a welded joint pressing an impact pin against the surface of a base metal material near a toe of a weld bead and making it move relatively to the weld line direction to apply hammer peening treatment or ultrasonic impact treatment, said impact treatment device for improving the fatigue characteristics of a welded joint characterized by being provided with a toe position detector detecting the position of the toe of the weld bead of a treated material having the welded joint, a treatment mechanism applying hammer peening treatment or ultrasonic impact treatment with the impact pin, a support pressing mechanism supporting the treatment mechanism and pressing the impact pin against the surface of the base metal material separated from the toe of the weld bead of the treated material by a predetermined distance, a device base on which one of the support pressing mechanism or treated material is mounted, and a movement mechanism on which the other of the support pressing mechanism or treated material is mounted, the mechanism itself being mounted on the device base, and relatively moving the treatment mechanism in the weld line direction based on the toe position of the weld bead detected by the welding toe position detector.

(3) A welded structure superior in fatigue resistance characteristics in which a weld zone or weld bead of a fatigue crack risk zone can be identified from a structure and load status of a welded structure, said welded structure characterized in that at least a surface of a base metal material in the vicinity of a toe of the identified weld bead is formed with a continuous impact dent having a length of 90% or more of the length of the identified weld bead and formed by an impact pin in hammer peening treatment or ultrasonic impact treatment and in that the impact dent is formed on the surface of the base metal material up to a range where a distance between a center position in the width direction and the toe of the weld bead is within 2.5 times the curvature radius of the groove bottom and not contacting the identified weld bead and has a groove depth of 0.1 to 2 mm, the groove bottom curvature radius or less, and 1/10th or less of the thickness of the metal material and has a width of 1.5 to 15 mm and five times the groove depth or more.

DESCRIPTION OF EMBODIMENTS

Figure 1:
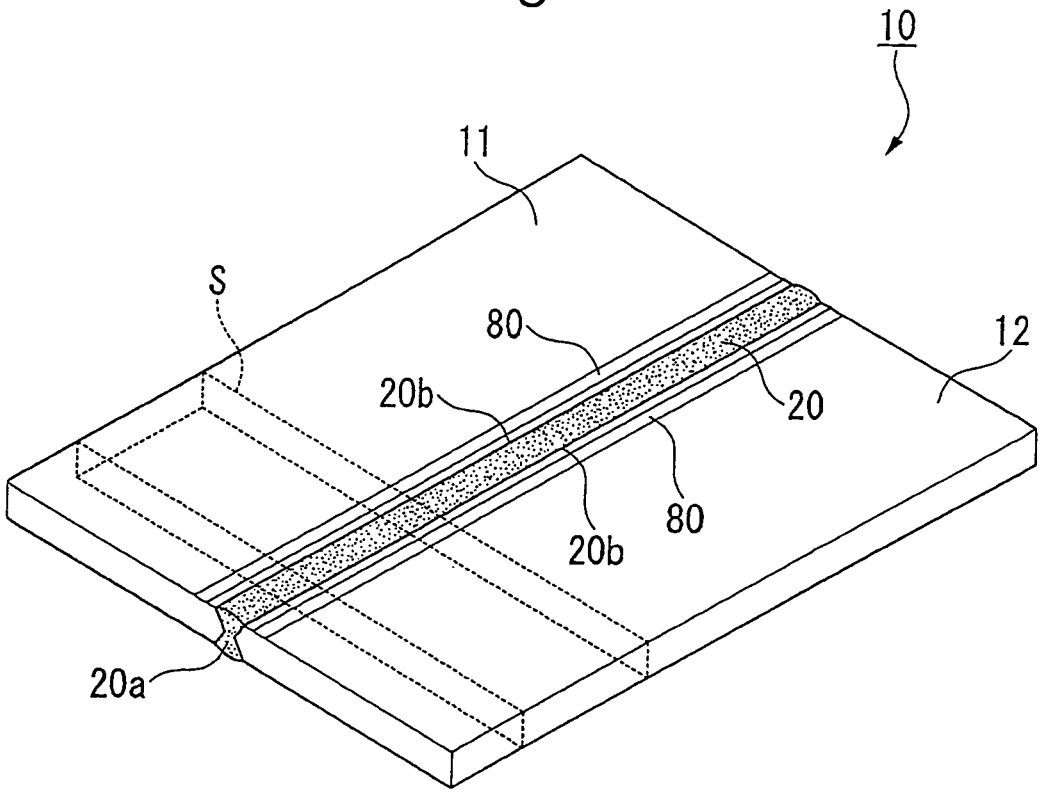
FIG. 1 is a perspective view showing an example of a welded joint to which the present invention is applied.

Below, embodiment of the present invention will be explained in detail referring to the drawings.

Note that, the drawings used in the following explanation sometimes schematically show characterizing portions for convenience for facilitating understanding of the features. The ratios of dimensions of the components and the like are not always the same as the actual state.

The present invention provides an impact treatment method for improving fatigue characteristics of a welded joint comprising pressing an impact pin against a surface of a base metal material near a toe of a weld bead and relatively moving it in the weld line direction to apply hammer peening treatment or ultrasonic impact treatment and thereby improve the fatigue characteristics of the welded joint and an impact treatment device for improving fatigue characteristics of the same and a welded structure superior in fatigue resistance characteristics.

(Welded Joint)

First, a welded joint to which the present invention is applied will be explained.

As a welded joint to which the present invention is applied, for example a welded joint 10 such shown in FIG. 1 may be mentioned. This welded joint 10 is a so-called butt welded joint 10 formed by welding the end face of one steel plate 11 to the end face of another steel plate 12 facing each other in the same plane. When carrying out such welding, grooves are often machined in advance on the welding faces of the welding materials, that is, the one steel plate 11 and other steel plate 12. The grooves of these steel plates 11 and 12 are butt welded, whereby a weld bead 20 is formed protruding towards the external sides of the steel plates rather from their surfaces.

Further, in the present invention, in the vicinity of the boundary where the surface of the weld metal 20*a* of such a weld bead 20 intersects a surface of a metal materials of a base material (steel plate 11 or 12) (referred to as the toe 20*b* of the weld bead 20), an impact pin 50 explained later is pressed and made to move relatively in the weld line direction while applying hammer peening treatment or ultrasonic impact treatment. Due to this, an impact dent 80 explained later is formed on the surface of the base metal material (steel plate 11 or 12) near the toe 20*b* of the weld bead 20.

Figure 2:
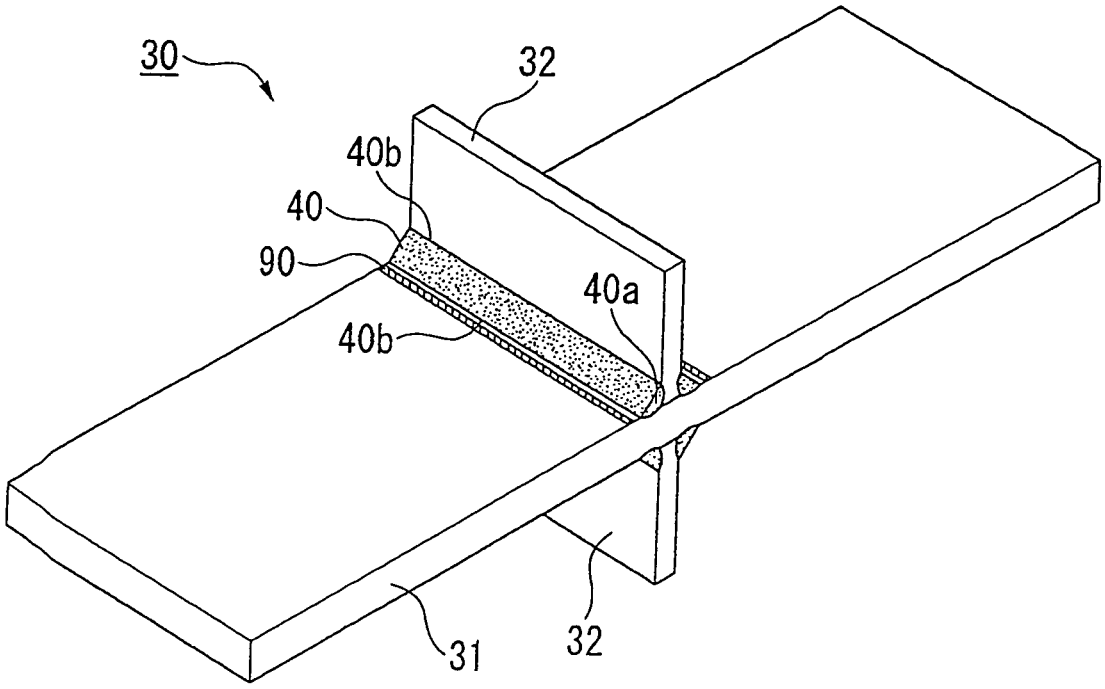
FIG. 2 is a perspective view showing another example of a welded joint to which the present invention is applied.

Further, as a welded joint to which the present invention is applied, for example a welded joint 30 such as shown in FIG. 2 may be mentioned. This welded joint 30 is a so-called cruciform welded joint formed by positioning end faces of steel plates 32 at facing positions of two main surfaces of a steel plate 31 and fillet welding them. Further, weld beads 40 comprised of weld metal 40*a* having triangular cross-sections are formed at portions where the two main surfaces of the steel plate 32 perpendicularly intersect the two main surfaces of the steel plate 31 (referred to as "corners").

Further, in the present invention, an impact pin 50 explained later is pressed against the vicinity of the side of the base metal material (steel plate 31 or 32) at the boundary where the surface of the weld metal 40*a* of a weld bead 40 intersects the surface of the base metal material (steel plate 31 or 32) (referred to as the toe 40*b* of the weld bead 40) and moved relatively in the weld line direction while applying hammer peening treatment or ultrasonic impact treatment. Due to this, an impact dent 90 explained later is formed at the surface of the base metal material (steel plate 31 or 32) in the vicinity of the toe 40*b* of the weld bead 40.

Note that, the welded joint to which the present invention is applied is not limited to the butt welded joint 10 shown in the above FIG. 1 or the cruciform welded joint 30 shown in the above FIG. 2. The present invention may be widely applied to welded joints where one member is welded to another member, including ones where the weld bead is curved. Further, a variety of welding methods may be used as the welding methods for such welded joints 10 and 30. Further, one-pass welding to multi-pass welding may also be applied.

(Impact Treatment Method for Improving Fatigue Characteristics of Welded Joint)

Next, an impact treatment method for improving fatigue characteristics of a welded joint applying the present invention will be explained.

Note that, the present embodiment will be explained giving as an example a case of applying treatment to a surface of a base metal material in the vicinity of the toe 20*b* of the weld bead 20 contacting the main surface of the steel plate 11 (base metal material) of the above welded joint 10.

Figure 3:
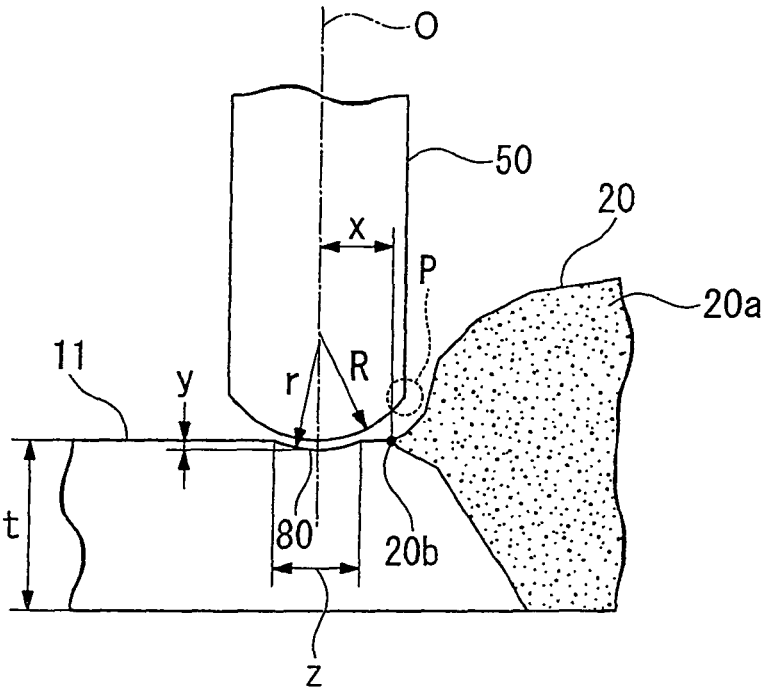
FIG. 3 is a cross-sectional view showing a state where an impact is formed by an impact pin on the surface of a base metal material.

An impact treatment method for improving fatigue characteristics of a welded joint applying the present invention is characterized by, as shown enlarged in FIG. 3, using, as an impact pin, an impact pin 50 having a tip curvature radius R of half or less of the thickness of the steel plate 11 and between 2 to 10 mm to apply hammer peening or ultrasonic impact treatment on the surface of a base metal material (steel plate 11) up to a range where the distance x from the toe 20*b* of the weld bead 20 to the center O of the impact treatment position is within 2.5 times the tip curvature radius R of the impact pin 50 and where the impact pin 50 does not contact the weld metal 20*a* during impact treatment, so as to form on it by the impact pin 50 residual plastic deformation where an impact dent 80 has a groove depth y of 0.1 to 2 mm, the tip curvature radius R of the impact pin 50 or less, and 1/10th or less of the thickness t of the steel plate 11 and where the impact dent 80 has a width z of 1.5 to 15 mm and five times or more the groove depth y.

Specifically, the reason why "an impact pin 50 having a tip curvature radius R of half or less the thickness of the steel plate 11 and between 2 to 10 mm" is used in the present invention is because post-treatment residual compressive stress has an effect of improvement of the fatigue characteristics and because the size of the compressive residual stress region is related to the size of the indentations caused by the impact pin 50.

That is, when the tip curvature radius R of the impact pin 50 is greater than ½ of the thickness of the steel plate 11, it will become necessary to give an impact dent 80 giving a strain to the point of plastic deformation across almost the entire thickness of the steel plate 11. In this case, the plastic region due to the impact dent will end up passing through to the opposite side of the steel plate 11, so the compressive residual stress generated at the toe portion of the weld bead 20 will become small.

Further, if the tip curvature radius R of the impact pin 50 is smaller than 2 mm, the compressive residual stress region becomes narrower, so it becomes necessary to strike the immediate vicinity of the toe 20*b* of the weld bead 20 to prevent fatigue cracks. However, due to weld bead 20 wrinkling and the like, controlling the treatment position accurately is difficult. Further, abrasion at the tip of the impact pin 50 will become intense and the frequency of replacing the impact pin 50 will increase, thereby reducing treatment efficiency.

On the other hand, when the tip curvature radius R of the impact pin 50 exceeds 10 mm, it will become necessary to give an extremely large impact force to form a groove enough to generate effective compressive residual stress and the treatment device will become large in size. Further, there are concerns that the impact treatment will end up deforming the shape of the welded structure 10.

Further, because the impact pin 50 impacts the object to be treated locally and plastically deforms it due to the hammer peening treatment or ultrasonic impact treatment, the impact pin 50 normally is made using a metal material having a strength and hardness higher than those of the metal material of the object to be treated (for example, steel for a welded structure).

The reason why "the distance x from the toe 20*b* of the weld bead 20 to the center O of the impact treatment position is within 2.5 times the tip curvature radius R of the impact pin 50" in the present invention is because the size of the above-mentioned compressive residual stress region is related to the size of the impact dent 80 made by the impact pin 50. That is, it has been confirmed by FEM analysis and experiments that the greater the tip curvature radius R of the impact pin 50, the wider the generated region of compressive residual stress and, further, that the closer from the impact dent 80, the larger the compressive residual stress generated and it has been confirmed that a compressive residual stress sufficient for improving fatigue characteristics can be obtained. Therefore, even if the impact dent is within a designated range, it is preferable for it to be as close to the weld toe portion as possible.

The reason for "applying hammer peening or ultrasonic impact treatment on the surface of a base metal material (steel plate 11) up to a range where . . . the impact pin 50 does not contact the weld metal 20*a* during impact treatment, so as to form on it by the impact pin 50 residual plastic deformation" in the present invention is because continuous impact treatment by the impact pin 50 may be obstructed when the impact pin 50 contacts the weld metal 20*a*. Note that, in the present invention, unless continuous impact treatment is significantly obstructed, the impact pin 50 may make contact with the weld metal 20*a* to some extent.

The reason for the "impact dent 80 groove depth y being 0.1 to 2 mm, less than or equal to the impact pin 50 tip curvature radius R, and less than or equal to 1/10th the thickness of the metal material (steel plate 11), and the impact dent 80 width z being 1.5 to 15 mm and greater than or equal to five times the groove depth y" in the present invention is because an impact dent 80 that is too deep itself will become a source of stress concentration and a large angular deformation will form on the welded joint 10, deforming the shape. Further, when the width z of the impact dent 80 is too wide, the treatment efficiency may fall, and if the impact dent 80 is shallow and narrow, compressive residual stress that is effective for fatigue characteristics will be generated but be insufficient. Further, the width z of the impact dent 80 is determined by the tip curvature radius R of the impact pin 50 and the treatment depth, however, the width z here is set taking into account the wobbling of the device and target position during treatment. That is, the width z of the impact dent 80 will fall in the above range if an impact having a sufficient depth is provided, however, there will not be major damage to the fatigue characteristics even if this range is exceeded due to an impact pin 50 having a large tip curvature radius R, but the treatment efficiency will fall. Further, when the curvature radius of the impact pin tip is large, P of FIG. 3 can come into contact with the weld metal easily, thus the pin diameter may be made thin to a range where a sufficient impact dent width is obtained. Further, the P portion of FIG. 3 where the tip curvature is terminated may be chamfered and its shape smoothed.

(Impact Treatment Device for Improving Fatigue Characteristics of Welded Joint)

Next, an impact treatment device for improving the fatigue characteristics of a welded joint applying the present invention will be explained.

Impact treatment devices for improving the fatigue characteristics of a welded joint applying the present invention may be broadly classified into two types. One is a type like the impact treatment device for improving fatigue characteristics 60 (first embodiment) shown in FIG. 4 where the treatment mechanism side is fixed in place and the treated material side is made to move, while the other is a type like the impact treatment device for improving fatigue characteristics 70 (second embodiment) shown in FIG. 5 where the treated material side if fixed in place and the treatment mechanism side is made to move. As to which type to select, this is preferably suitably selected according to the object to be treated and the treatment environment (treatment of an outdoor structure, treatment within a factory, and the like).

Note that, the first and second embodiments shown below will be explained giving as an example a case of improving the fatigue characteristics of the above welded joint 10 as the treated material, however, the object to be treated may be the above welded joint 30 as well. Further, treatment may be widely carried out on welded structures having welded joints where one member is welded to another member.

First Embodiment

Figure 4:
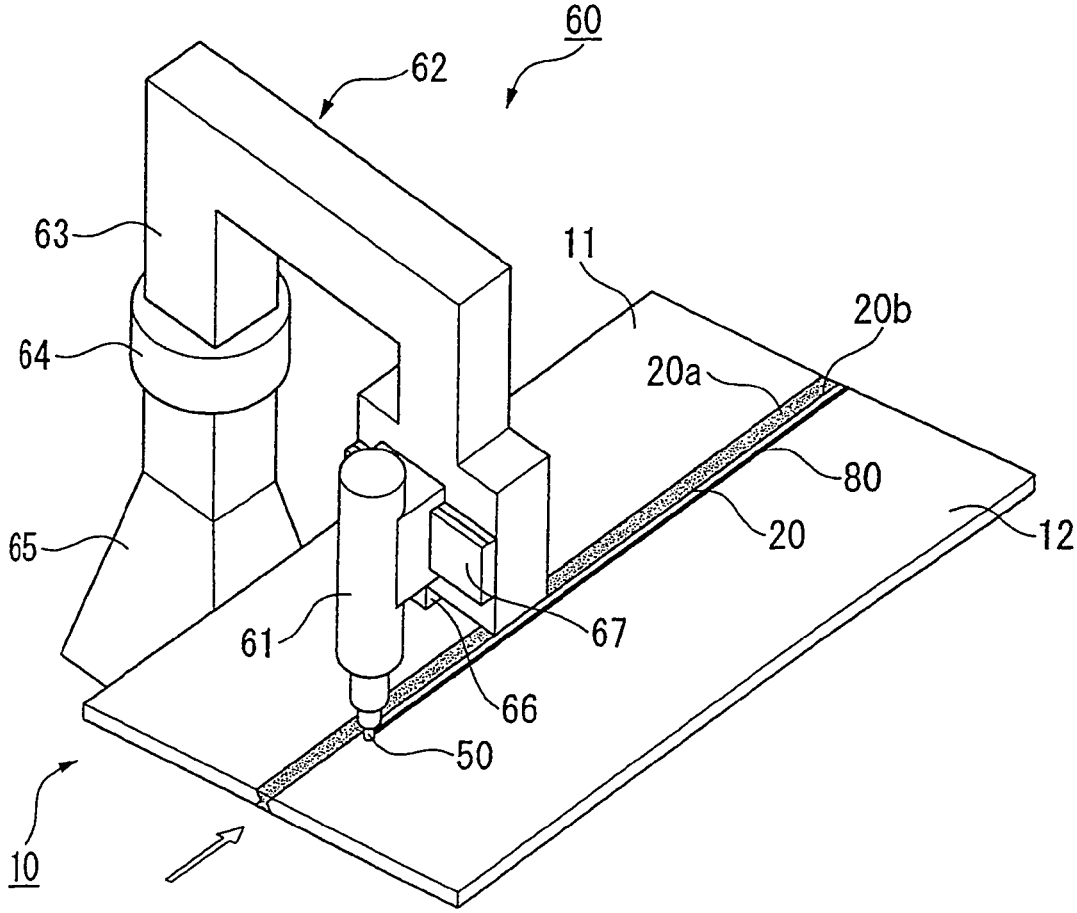
FIG. 4 is a perspective view showing an example of an impact treatment device for improving the fatigue characteristics of a welded joint applying the present invention.

In the impact treatment device for improving fatigue characteristics 60 shown in FIG. 4 as the first embodiment, the treatment mechanism side is fixed to the device base 65, and a movement mechanism (not shown) carrying the treated material (welded joint) and sliding is provided on the device base 65. This movement mechanism may move the welded joint 10 in a state where the sliding direction and the longitudinal direction of the weld bead 20 are matched.

Further, the impact treatment device for improving fatigue characteristics 60 is provided with a treatment mechanism 61 positioned above this movement mechanism and fit with the impact pin 50 and a support pressing mechanism 62 to which this treatment mechanism 61 is attached. This support pressing mechanism 62 comprises a support arm 63 and a pressing device 64 and is fixed to the device base 65.

The treatment mechanism 61 presses the impact pin 50 against the surface of base metal material (steel plate 11 or 12) separated from the toe 20*b* of the weld bead 20 by a predetermined distance and applies hammer peening treatment or ultrasonic impact treatment. Ones disclosed in for example the Patent Literatures 1 to 3 and the like may be employed. Note that, hammer peening treatment and ultrasonic impact treatment were known in the past, and thus detailed explanations are omitted. Note that, in the present invention, either of the impact treatments of hammer peening treatment or ultrasonic impact treatment may be used, however, because the recoil in treatment is comparatively low, the treatment output is high, etc., ultrasonic impact treatment is more advantageous than hammer peening treatment. Further, it is possible to carry out impact treatment using air tools and other vibrating tools, however, the output is small and in comparison to ultrasonic impact treatment, the treatment efficiency is generally low.

The support pressing mechanism 62 supports the treatment mechanism 61 so that while pressing the tip of the impact pin 50 against the surface of the base metal material (steel plate 11 or 12) with an appropriate load, the impact pin 50 does not deviate from the targeted treatment position due to impact vibration. Further, it is sufficient for the support pressing mechanism 62 to generate a pressing load to the extent of the weight (several hundred grams to several dozen kilograms) of the treatment mechanism 61 from the general treatment conditions of hammer peening treatment or ultrasonic impact treatment carried out by the treatment mechanism 61. Note that, a mechanism absorbing the recoil from the impact pin 50 may be added to the support pressing mechanism 62 to protect the device and the like.

In this regard, to position the impact pin 50 at the surface of the base metal material (steel plate 11 or 12) which is separated from the toe 20*b* of the weld bead 20 by a predetermined distance, it is necessary to confirm the position of the toe 20*b* on the untreated portion in the treatment direction. Therefore, the impact treatment device for improving fatigue characteristics 60 is provided with a toe position detector 66 for detecting the toe position of the weld bead 20.

For this toe position detector 66, a shape sensor obtaining advanced information by a laser or an edge sensor identifying the base metal material (steel plate 11 or 12) and weld metal 20*a* from an image used for a toe sensor or other sensor recognizing the boundary between the base metal material (steel plate 11 or 12) and the weld metal 20*a* is preferably used. Further, when the shape or position of the toe 20*b* is already known in advance, the toe sensor may be omitted, and the impact pin 50 moved in correspondence to the already known toe 20*b* of the weld bead 20.

Further, this impact treatment device for improving fatigue characteristics 60 is provided with an impact pin position controller 67 controlling the movement of the impact pin 50 to a direction intersecting the weld line direction based on the toe position of the weld bead 20 detected by the welding toe position detector 66. This impact pin position controller 67 is positioned between the treatment mechanism 61 and the support pressing mechanism 62 and controls the movement of the treatment mechanism 61 mounted slidably on the support pressing mechanism 62 to a direction intersecting the weld line direction.

The impact treatment device for improving fatigue characteristics 60 having the above such structure is able to relatively move the impact pin 50 in the weld line direction with respect to the welded joint 10 by the movement mechanism sliding the welded joint 10 while pressing the impact pin 50 against the surface of the base metal material (steel plate 11 or 12) separated from the toe 20*b* of the weld bead 20 by a predetermined distance based on the toe position of the weld bead 20 detected by the welding toe position detector 66. Due to this, it is possible to carry out continuous hammer peening treatment or ultrasonic impact treatment with the impact pin 50.

That is, this impact treatment device for improving fatigue characteristics 60 continuously carries out impact treatment with the impact pin 50 on the surface of the base metal material (steel material 11 or 12) which is separated by a predetermined distance from a position of origin of a fatigue crack, that is, the toe 20*b* of the weld bead, making possible the addition of a compressive residual stress suitable for improving fatigue characteristics and thereby improving the fatigue characteristics of the welded joint 10 and enabling a welded structure having a high fatigue crack resistance property to be obtained.

Second Embodiment

Figure 5:
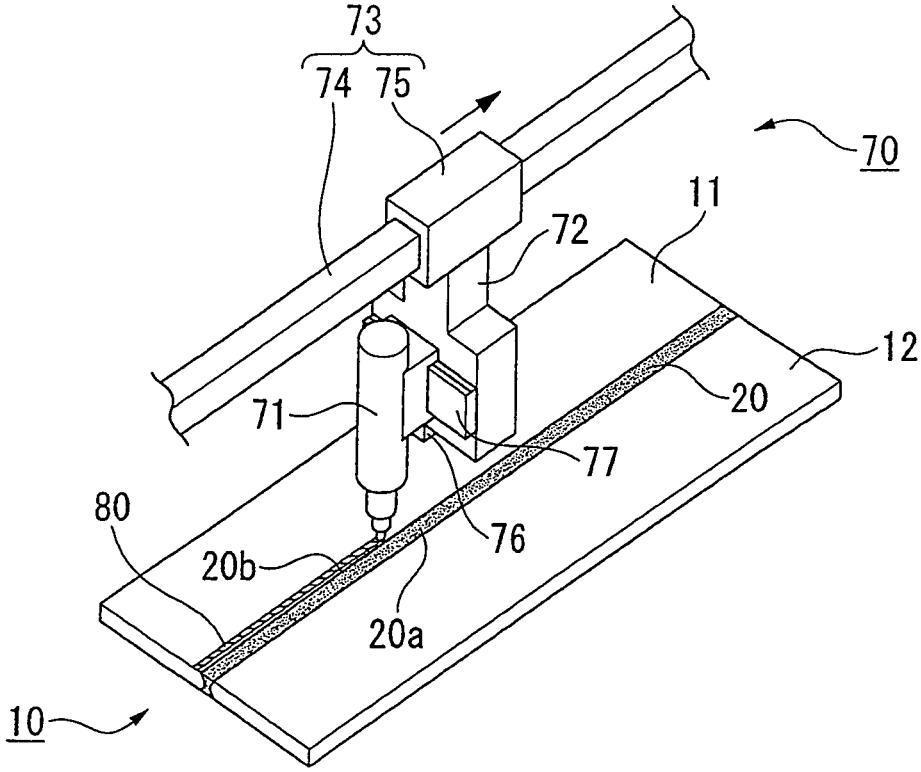
FIG. 5 is a perspective view showing another example of an impact treatment device for improving the fatigue characteristics of a welded joint applying the present invention.

The impact treatment device for improving fatigue characteristics 70 shown in FIG. 5 as the second embodiment is provided with a not shown device base. The welded joint 10 may be carried on this device base.

Further, the impact treatment device for improving fatigue characteristics 70 is provided with a treatment mechanism 71 positioned above this device base and fit with the impact pin 50, a support pressing mechanism 72 to which this treatment mechanism 71 is attached, and a movement mechanism 73 sliding this support pressing mechanism 72 in one direction.

The treatment mechanism 71 presses the impact pin 50 against the surface of the base metal material (steel plate 11 or 12) separated from the toe 20*b* of the weld bead 20 by a predetermined distance and applies hammer peening treatment or ultrasonic impact treatment. It may be ones disclosed in for example the Patent Literatures 1 to 3 and the like. Note that, hammer peening treatment and ultrasonic impact treatment were known in the past, and thus detailed explanations are omitted. Note that, in the present invention, either of the impact treatments of hammer peening treatment or ultrasonic impact treatment may be used, however, because the recoil in treatment is comparatively low, the treatment output is high, etc., ultrasonic impact treatment is more advantageous than hammer peening treatment. Further, it is possible to carry out impact treatment using air tools and other vibrating tools, however, the output is small and in comparison to ultrasonic impact treatment, the treatment efficiency is generally low.

The support pressing mechanism 72 supports the treatment mechanism 71 so that while pressing the tip of the impact pin 50 against the surface of the base metal material (steel plate 11 or 12) with an appropriate load, the impact pin 50 does not deviate from the targeted treatment position due to impact vibration. Further, it is sufficient for the support pressing mechanism 72 to generate a pressing load to the extent of the weight (several hundred grams to several dozen kilograms) of the treatment mechanism 71 from the general treatment conditions of hammer peening treatment or ultrasonic impact treatment carried out by the treatment mechanism 71. Note that, a mechanism absorbing the recoil from the impact pin 50 may be added to the support pressing mechanism 72 to protect the device and the like.

The movement mechanism 73 comprises a rail 74 arranged extending in one direction and a guide 75 running along this rail 74. By running an electric cart (not shown) arranged inside this guide 75 on top of the rail 74, it is possible for the support pressing mechanism 72 attached to the bottom surface of the guide 75 to slide in one direction.

In this regard, to position the impact pin 50 on the surface of the base metal material (steel plate 11 or 12) separated from the toe 20*b* of the weld bead 20 by a predetermined distance, it is necessary to confirm the position of the toe 20*b* on the untreated portion in the treatment direction. Therefore, the impact treatment device for improving fatigue characteristics 70 is provided with a toe position detector 76 detecting the toe position of the weld bead 20.

For this toe position detector 76, a shape sensor obtaining advanced information by a laser or an edge sensor identifying the base metal material (steel plate 11 or 12) and weld metal 20*a* from an image used for a toe sensor or other sensor recognizing the boundary between the base metal material (steel plate 11 or 12) and the weld metal 20*a* is preferably used. Further, when the shape or position of the toe 20*b* is already known in advance, the toe sensor may be omitted, and the impact pin 50 moved in correspondence to the already known toe 20*b* of the weld bead 20.

Further, this impact treatment device for improving fatigue characteristics 70 is provided with an impact pin position controller 77 controlling the movement of the impact pin 50 to a direction intersecting the weld line direction based on the toe position of the weld bead 20 detected by the welding toe position detector 76. This impact pin position controller 77 is positioned between the treatment mechanism 71 and the support pressing mechanism 72 and controls the movement of the treatment mechanism 71 mounted slidably on the support pressing mechanism 72 to a direction intersecting the weld line direction.

The impact treatment device for improving fatigue characteristics 70 having the above such structure has the welded joint carried on the device base in a state where the above one direction is matched with the longitudinal direction of the weld bead 20 and is able to relatively move the impact pin 50 in the weld line direction of the welded joint 10 by the movement mechanism sliding the support pressing mechanism 72 while pressing the impact pin 50 against the surface of the base metal material (steel plate 11 or 12) separated from the toe 20*b* of the weld bead 20 by a predetermined distance based on the toe position of the weld bead 20 detected by the welding toe position detector 76. Due to this, it is possible to carry out continuous hammer peening treatment or ultrasonic impact treatment with the impact pin 50.

That is, this impact treatment device for improving fatigue characteristics 70 continuously carries out impact treatment with the impact pin 50 on the surface of the base metal material (steel material 11 or 12) separated by a predetermined distance from a position of origin of a fatigue crack, that is, the toe 20*b* of the weld bead, making possible the addition of a compressive residual stress suitable for improving fatigue characteristics, thereby improving the fatigue characteristics of the welded joint 10 "and allowing a welded structure having a high fatigue crack resistance property to be obtained.

Further, the position to apply impact treatment is preferably made a position close to the toe 20*b* of the weld bead 20 so as to give a compressive residual stress so large that the tensile residual stress being generated by welding at the toe portion of the weld bead 20 can be reversed to the compression side. The distance from the toe 20*b* is within 2.5 times the tip curvature radius of the above impact pin 50 and a range where the impact pin 50 does not contact the weld metal 20*a* during impact treatment.

(Welded Structure)

Next, a welded structure applying the present invention will be explained.

As the welded structure covered by the present invention, a welded structure in which the weld zone or weld bead of a fatigue crack risk zone can be identified from the structure and load status is assumed. Note that, this identified fatigue crack risk zone position is identified from the structure and load status for each welded structure if a specific welded structure is identified, for example, the weld zones of girders and supports for bridges, and the weld zones of stringer frame members and side plates for boats.

In the following explanation, the example is given of a welded structure having a welded joint 10 improved in fatigue characteristics by the impact treatment method for improving fatigue characteristics and the impact treatment device for improving fatigue characteristics applying the present invention, however, the welded structure applying the present invention may also be one having the welded joint 30. Further, the present invention may be widely applied to welded structures having welded joints where one member is welded to another member.

The welded structure applying the present invention is one where the weld zone or weld bead 20 of a fatigue crack risk zone can be identified from the structure and load status, characterized in that at least a surface of a base metal material (steel plate 11 or 12) in the vicinity of a toe 20*b* of the identified weld bead 20 of the welded joint 10 is formed with a continuous impact dent 80 having a length of 90% or more of the length of the identified weld bead 20 and formed by an impact pin in hammer peening treatment or ultrasonic impact treatment and in that the impact dent 80 is formed on the surface of the base metal material (steel plate 11 or 12) up to a range where a distance x between a center position in the width direction and the toe 20*b* of the weld bead 20 is within 2.5 times the curvature radius of the groove bottom and not contacting the identified weld bead 20 and has a groove depth y of 0.1 to 2 mm, the groove bottom curvature radius r or less, and 1/10th or less of the thickness t of the metal material (steel plate 11 or 12) and has a width of 1.5 to 15 mm and five times the groove depth y or more.

The reason for "at least a surface of a base metal material (steel plate 11 or 12) in the vicinity of a toe 20*b* of the identified weld bead 20 of the welded joint 10 is formed with a continuous impact dent 80 having a length of 90% or more of the length of the identified weld bead 20 and formed by an impact pin in hammer peening treatment or ultrasonic impact treatment" in the present invention is the residual stress state of the toe portion of a weld bead 20 requiring fatigue characteristic improvement can be made into compressive stress by impact treatment by treatment having a length that is the same or greater than the length of the weld bead of the position to be treated. Further, even if there is a position where sufficient treatment is not carried out partially, because the fatigue crack risk zone, that is, the toe 20*b* of the identified weld bead 20, and the impact dent 80 are separated from each other, a sufficient compressive residual stress will be generated even with even 90% of the bead length.

The reason for "the impact dent 80 is formed on the surface of the base metal material (steel plate 11 or 12) up to a range where a distance x between a center position in the width direction and the toe 20*b* of the weld bead 20 is within 2.5 times the curvature radius of the groove bottom and not contacting the identified weld bead 20 and has a groove depth y of 0.1 to 2 mm, the groove bottom curvature radius r or less, and 1/10th or less of the thickness t of the metal material (steel plate 11 or 12) and has a width of 1.5 to 15 mm and five times the groove depth y or more" in the present invention is because when the weld metal 20*a* is contacted by the impact pin 50 (particularly the vicinity of the boundary between the cylindrical part of the impact pin 50 and the tip curvature part shown in the enclosed part P in FIG. 3), an impact dent 80 contacting the weld bead 20 is formed making the discovery of a welding fault difficult when there is a welding fault in the toe 20*b*. Note that, as long as the impact dent 80 is one that is minor to the extent that the discovery of the weld fault will not be obstructed, even if such an impact dent 80 is formed, the effects of the present invention will not be damaged.

Further, it has been confirmed by FEM analysis and experiments that a compressive residual stress sufficient for improving fatigue characteristics is obtained when the impact dent 80 is formed on the base metal material (steel plate 11 or 12) up to a range where the distance x between the width direction center position of the impact dent 80 and the toe 20*b* of the identified weld bead 20 is within 2.5 times the curvature radius r of its groove bottom and where it does not contact the identified weld bead 20.

Figure 6:
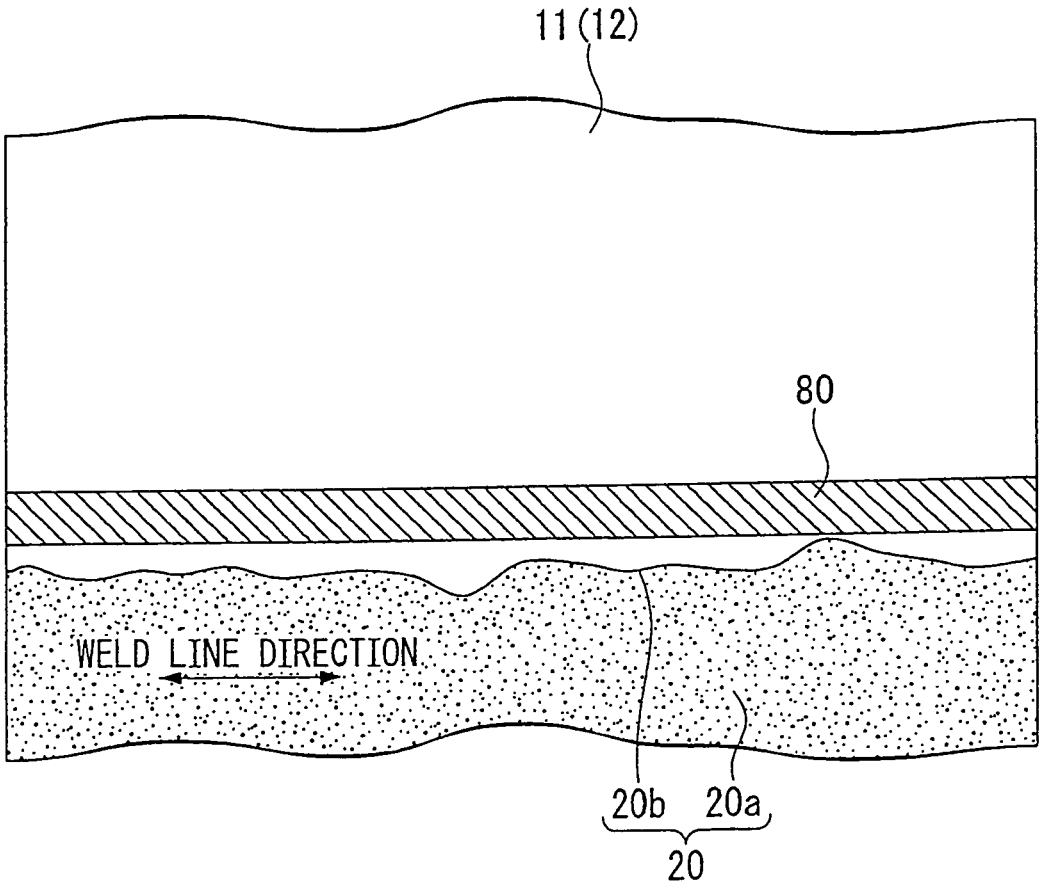
FIG. 6 is a plane view showing an example of an impact dent when the wrinkling of the toe of the weld bead is small.
Figure 7:
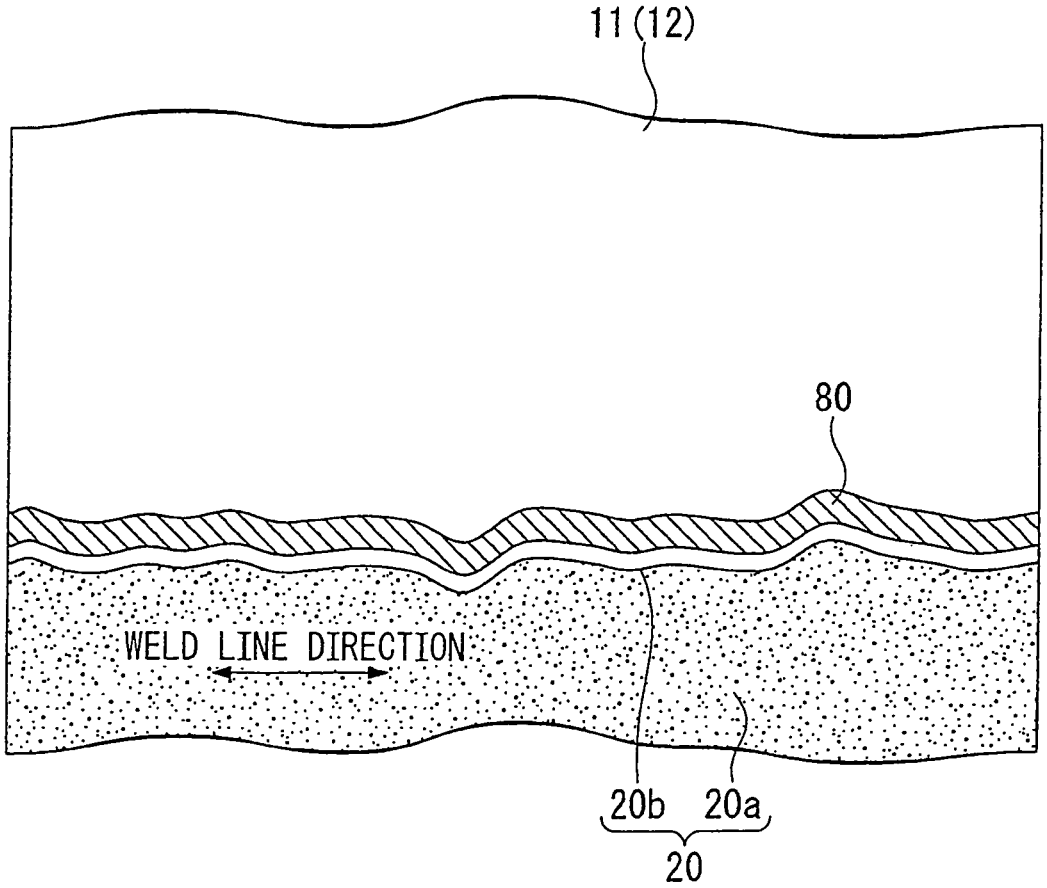
FIG. 7 is a plane view showing an example of an impact dent when the wrinkling of the toe of the weld bead is large.

Note that, if within the above range, it is allowable for the distance x from the toe 20*b* of the weld bead 20 to the treatment position to fluctuate somewhat, for example, as shown in FIG. 6, when the wrinkling on the toe 20*b* of the weld bead 20 is comparatively small, impact treatment can be carried out with control of the treatment position along the weld line direction overall. On the other hand, as shown in FIG. 7, when the wrinkling of the toe 20*b* of the weld bead 20 is comparatively large, impact treatment can be carried out while making the impact pin 50 follow the toe shape of the weld bead 20 based on the toe position of the weld bead 20 detected by the above welding toe position detector 66 or 76.

Further, the reason why the impact dent 80 has a channel depth y of 0.1 to 2 mm, the groove bottom curvature radius r or less, and 1/10th or less the thickness t of the metal material (steel plate 11 or 12) and a width w of 1.5 to 15 mm and five times or more the groove depth y is because an impact dent 80 that is too deep will itself become a source of stress concentration, causing a large angular deformation to form on the welded joint 10, and the shape of the welded structure to be deformed. Further, when the width of the impact dent 80 is too great, the treatment efficiency may fall, and if the impact dent 80 is shallow and narrow, compressive residual stress that is effective for fatigue characteristics will be generated but be insufficient.

The width w of the impact dent 80 is determined by the tip curvature radius R of the impact pin 50 and the treatment depth, however, the width w here is set taking into account the wobbling of the device and the target position during treatment and will fall in this range if an impact having a sufficient depth y is provided, however, there will not be major damage to the fatigue characteristics even if this range is exceeded due to an impact pin 50 having a large tip curvature radius R, but the treatment efficiency will fall.

EXAMPLES

Below, examples will be used to make the advantageous effects of the present invention clearer. Note that, the present invention is not limited to the following examples and may be carried out with appropriate changes to the extent that the gist is not changed.

First Example

In the first example, first, 25 cruciform weld test pieces having structures similar to the welded joint 30 shown in FIG. 2 were actually prepared. Specifically, for the cruciform weld test pieces, cruciform welded joints having 1800 mm welding lengths were formed by fillet arc welding. Further, the steel plates used for the cruciform welded test pieces were 25 mm thick SM490B based on JIS G 3106. Further, the weld materials were YGW11 based on JIS Z 3312 and the welding conditions were a welding heat input of $2.5\times10^4$ J/cm and $CO_2$ semiautomatic arc welding.

Next, using the impact treatment device for improving fatigue characteristics 70 shown in FIG. 5, these cruciform weld test pieces were subjected to impact treatment for improving the fatigue characteristics of their welded joints. Specifically, the cruciform weld test pieces were fixed to the treated material carrying surface of the device base so that the weld beads were connected in one line, then the impact pin 50 was pressed against the surface of the base metal material (steel plate 31) in the vicinity of a toe 40*b* of a weld bead 40 and the treatment mechanism side was moved in the weld line direction by the movement mechanism 73 while ultrasonic impact treatment was applied. Note that, ultrasonic impact treatment was only applied to the vicinities of the toes 40*b* at our locations of the steel plates 31 of the main plates given the test load. Treatment at the vicinity of the toes 40*b* of the steel plates 30 of the rib plates without test load was omitted.

The vibrational frequency of the ultrasonic impact treatment was 27 kHz and the output was approximately 1000 W. The impact pin was of a type similar to the impact pin 50 shown in the above FIG. 3. One having a diameter of 3 mm or 6.4 mm and a tip curvature radius of 1.5 to 12 mm was used. Further, the pressing force (load) of the impact pin when applying ultrasonic impact treatment was made approximately 6 kg (approximately 60 N) by holding the device so as to become the weight of the treatment mechanism, and the treatment rate was adjusted to a 50 to 300 mm/min range so that the depth of the groove indentation of the treatment part became 0.5 mm.

The angle of the impact pin was adjusted so that it impacts perpendicularly to the metal material (steel plate 31) surface so that the impact energy was efficiently transmitted to the steel plate. At this time, to avoid interference with the cruciform weld test pieces, in the treatment mechanism 71, the shape of the tip of the wave guide inside the device was adjusted and the angle was set so that it was perpendicular to the weld line direction and tilted approximately 60 degrees with respect to the metal material (steel plate 31).

Note that, taking into account the recoil of ultrasonic impact treatment, an approximately 150 kg weight was added to the electric cart of the guide 75.

Further, as shown in Table 1, of the 25 cruciform weld test pieces before treatment, 18 of the cruciform weld test pieces were subjected to ultrasonic impact treatment with different treatment conditions. That is, tip curvature radius of the impact pin was changed in stages to 1.5 mm, 2 mm, 5 mm, 10 mm, and 12 mm, and ultrasonic impact treatment was applied at the vicinity of the toe at four locations of each cruciform welded test piece.

Next, after applying ultrasonic impact treatment, test pieces a1 to a18 corresponding to S in FIG. 1 in the case of replacing the steel plate 31 having a weld zone in the center of FIG. 2 with the butt welded steel plates 11, 12 of FIG. 1 were taken from each cruciform weld test piece and a fatigue test is carried out on the test pieces a1 to a18. Further, the test piece a0 extracted from the cruciform weld test pieces before treatment was also subjected to the same fatigue test. The fatigue test was a repeated tensile test in the axial direction having a stress ratio of 0.1 and a repeated load frequency of 6 Hz. The maximum stress was made 175 MPa. The number of repetitions until a crack formed in a weld zone and the test piece broke (fatigue life) was measured. The evaluation results are shown in Table 1.

TABLE 1

| Test piece symbol | Pin tip curvature radius (mm) | Distance from tip to center of treatment position | Treatment indentation depth | Indentation width | Pin diameter | Interference with weld metal (%) | Treatment time (min) | Fatigue life (cycles) |
|---|---|---|---|---|---|---|---|---|
| a0 | | | No treatment (basic condition) | | | | | 67000 |
| a1 | 1.5 | 2 | 0.5 | 2.7 | 3 | 30 | 5 | 212080 |
| a2 | | 3.5 | 0.5 | 2.7 | 3 | 0 | 1 | 205060 |
| a3 | | 5 | 0.5 | 2.7 | 3 | 0 | 1 | 102693 |
| a4 | 2 | 2 | 0.5 | 3.2 | 3 | 20 | 4 | 268409 |
| a5 | | 5 | 0.5 | 3.2 | 3 | 0 | 1 | 226525 |
| a6 | | 6 | 0.5 | 3.2 | 3 | 0 | 1 | 111822 |
| a7 | 5 | 3 | 0.5 | 5.2 | 6.4 | 25 | 4 | 253333 |
| a8 | | 5 | 0.5 | 5.2 | 6.4 | 2 | 2 | 239573 |
| a9 | | 12.5 | 0.5 | 5.2 | 6.4 | 0 | 1 | 201041 |
| a10 | | 14 | 0.5 | 5.2 | 6.4 | 0 | 1 | 108524 |
| a11 | 10 | 5 | 0.5 | 7.5 | 6.4 | 8 | 3 | 240747 |
| a12 | | 10 | 0.5 | 7.5 | 6.4 | 0 | 2 | 234439 |

TABLE 1-continued

| Test piece symbol | Pin tip curvature radius (mm) | Distance from tip to center of treatment position | Treatment indentation depth | Indentation width | Pin diameter | Interference with weld metal (%) | Treatment time (min) | Fatigue life (cycles) |
|---|---|---|---|---|---|---|---|---|
| a13 | | 25 | 0.5 | 7.5 | 6.4 | 0 | 2 | 200115 |
| a14 | | 26 | 0.5 | 7.5 | 6.4 | 0 | 2 | 122769 |
| a15 | 12 | 6 | 0.5 | 7.7 | 6.4 | 4 | 5 | 183727 |
| a16 | | 12 | 0.5 | 7.7 | 6.4 | 0 | 3 | 209123 |
| a17 | | 30 | 0.5 | 7.7 | 6.4 | 0 | 3 | 176639 |
| a18 | | 31 | 0.5 | 7.7 | 6.4 | 0 | 3 | 79735 |

As shown in Table 1, when the tip curvature radius of the impact pin was 1.5 mm (test pieces a1 to a3), an effect was obtained in terms of fatigue characteristic improvement, however, when the target position was close from the toe, the pin often hit the weld metal, whereby treatment halted, causing the treatment efficiency to drop. Further, this was also disadvantageous with respect to impact pin abrasion.

On the other hand, when the tip curvature radius of the impact pin was 12 mm (test pieces a15 to a18), the treatment indentation depth was often below 0.3 mm, and when the target position was moved away from the toe, the fatigue characteristic improvement effect became small. Further, when the target position was close, the edge of the impact pin often interfered with the weld metal, causing treatment to frequently halt, thereby reducing treatment efficiency. Further, to impart a sufficiently deep impact, it was necessary to make the treatment rate low, whereby the treatment efficiency dropped.

Next, the remaining seven cruciform weld test pieces were subjected to ultrasonic impact treatment with changed treatment conditions as shown in Table 2. That is, ultrasonic impact treatment was applied with the tip curvature radius of the impact pin being fixed at 5 mm, the treatment time changed, the treatment indentation depths changed in stages to 0.08 mm, 0.1 mm, 0.5 mm, 2 mm, and 2.5 mm, and a position 5 mm away from the toe targeted.

Then, after applying ultrasonic impact treatment, test pieces b1 to a7 corresponding to S in FIG. 1 were extracted from each cruciform welded test body, and a fatigue test is carried out for each test piece b1 to b7. The fatigue test was a repeated tensile test in the axial direction with a stress ratio of 0.1 and a repeated load frequency of 6 Hz. The maximum stress was made 175 MPa. The number of repetitions until a crack formed in a weld zone and the test piece broke (fatigue life) was measured. The evaluation results are shown in Table 2.

TABLE 2

| Test piece symbol | Pin tip curvature radius (mm) | Distance from tip to center of treatment position | Treatment indentation depth | Indentation width | Pin diameter | Interference with weld metal (%) | Treatment time (min) | Fatigue life (cycles) |
|---|---|---|---|---|---|---|---|---|
| b1 | 5 | 5 | 0.08 | 2.1 | 6.4 | 0 | 1 | 102940 |
| b2 | | 5 | 0.1 | 2.4 | 6.4 | 0 | 1 | 183876 |
| b3 | | 5 | 0.5 | 5.2 | 6.4 | 2 | 2 | 239573 |
| b4 | | 5 | 2 | 7.7 | 6.4 | 2 | 3 | 243105 |
| b5 | | 5 | 2.5 | 7.7 | 6.4 | 2 | 4 | 236794 |
| b6 | 10 | 10 | 2 | 14.4 | 15 | 7 | 5 | 182759 |
| b7 | 12 | 12 | 2 | 15.9 | 15 | 9 | 6 | 148695 |

As opposed to this, when the tip curvature radius of the impact pin was 2 to 10 mm (test pieces a4 to a14), there were few cases of treatment efficiency dropping and insufficient treatment and stable treatment could be achieved.

From the above results, it became clear that when the treatment position is close to the toe of the weld bead, a high fatigue life improvement effect is gained, however, when the impact pin interferes with the weld metal or when the tip curvature radius of the impact pin is large, the treatment efficiency drops. Based on these results, the present invention defined the tip curvature radius of the impact pin, the distance from the toe of the weld bead to the treatment center, and the interference ratio of the weld metal.

Note that, from the test results here, as shown in FIG. 7, the impact dents could be identified at positions indented in parallel to the toe shape. Further, it was found that interference with the weld metal occurs easily when the position where the toe shape of the weld bead suddenly changes and the wobbling of the impact pin during impact treatment overlap.

As shown in Table 2, when the treatment indentation depth was 0.1 mm or greater (test pieces b2 to b5), a clear fatigue characteristic improvement effect was obtained. However, when the treatment indentation depth exceeded 2 mm (test pieces b4 and b5), the treatment time became extremely long and extremely inefficient.

Further, confirmation of the effectiveness of the present invention when the thickness of the impact pin and the tip curvature radius were enlarged showed that under the test piece b7 having an impact pin with a large diameter, not only was the treatment time long, but a large angle deformation formed on the weld zone, creating a problem in its shape as a weld zone material. Therefore, it is thought that the use of impact pins up to the test piece b6 treatment condition is preferable as an appropriate treatment condition from the viewpoint of treatment efficiency. The effective range of the present invention was determined from the above test results.

Second Example

In the second example, first, four butt weld test pieces having a shape similar to the welded joint 10 shown in FIG. 1 were actually prepared. Specifically, in the butt weld test pieces, butt welded joints having a 550 mm welding length were formed by shielded arc welding. Note that, the groove of this butt welded joint was an X groove and the bead width of both surfaces was 18 to 21 mm. Further, the steel plates used in the butt weld test pieces were 20 mm thick SM400A based on JIS G 3106. Further, the weld materials were D4316 rods (diameter 4 mm) based on JIS Z 3311 and the welding conditions were a welding heat input of $1.7\times10^4$ J/cm and shielded arc welding.

Next, using the impact treatment device for improving fatigue characteristics 60 shown in FIG. 4, these butt weld test pieces were subjected to impact treatment for improving the fatigue characteristics of their welded joints. Specifically, the butt weld test pieces were fixed to the treated material carrying surface of the device base so that the weld beads were connected in one line, then the impact pin was pressed against the surface of a base metal material in the vicinity of a toe of a weld bead and the treatment mechanism side was moved in the weld line direction by the movement mechanism while ultrasonic impact treatment was applied. Note that, the ultrasonic impact treatment points were made the vicinities of the toes at four locations of the front and back surfaces of the steel plates 11, 12.

The vibrational frequency of the ultrasonic impact treatment was 27 kHz and the output as approximately 1000 W. The impact pin was a type similar to the impact pin 50 shown in the above FIG. 3. One having a diameter of 3 mm and a tip curvature radius of 5 mm was used. Further, the pressing force (load) of the impact pin when applying ultrasonic impact treatment was made approximately 4.5 kg (approximately 45N) by holding the device so as to become the weight of the treatment mechanism. The treatment rate was made 200 mm/min so that the indentation depth of the groove of the treatment part became 0.3 mm.

Further, of the four butt weld test pieces before treatment, three of the butt weld test pieces were subjected to ultrasonic impact treatment with different treatment conditions as shown in Table 3. Further, the toe of the weld bead of each butt welded test body wrinkles and the welding width fluctuates, however, this is manually adjusted and set so that the position of the 3 to 6 mm, 5 to 7 mm, and 11 to 14 mm steel plate surfaces can be impacted from the toe of the weld bead, whereby impact is given to the weld test pieces under each of these conditions.

Next, test pieces c1 to c4 such as shown in S of FIG. 1 were extracted from the three butt weld test pieces which underwent ultrasonic impact treatment and the one butt welded test body which was not subjected to impact treatment, and fatigue tests were carried out on the test pieces c1 to c4. The fatigue test was a repeated tensile test in the axial direction with a stress ratio of 0.1 and a repeated load frequency of 10 Hz. The maximum stress was made 200 MPa. The number of repetitions until a crack formed in a weld zone and the test piece broke (fatigue life) was measured. The evaluation results are shown in Table 3.

TABLE 3

| Test piece symbol | Pin tip curvature radius (mm) | Distance from tip to center of treatment position | Treatment indentation depth | Indentation width | Pin diameter | Interference with weld metal (%) | Treatment time (min) | Fatigue life (cycles) |
|---|---|---|---|---|---|---|---|---|
| c1 | 5 | 3 to 6 | 0.3 | 4.1 | 5 | 0 | 0.5 | 148000 |
| c2 | | 5 to 8 | 0.3 | 4.1 | 5 | 0 | 0.5 | 137500 |
| c3 | | 11 to 14 | 0.3 | 4.1 | 5 | 0 | 0.5 | 64500 |
| c4 | — | — | — | — | — | — | — | 47500 |

As shown in Table 3, the test piece c4 which did not undergo impact treatment broke at the $47500^{th}$ repetition. As opposed to this, the test pieces c1 and c2 which underwent the impact treatment of the present invention had lives 3 times longer, and test piece c3 showed some improvement. Further, in test piece c3, signs of a fatigue crack formed from a location where the distance between the toe of the weld bead to the impact treatment part was about 14 mm could be confirmed from the fracture surface of the test piece.

INDUSTRIAL APPLICABILITY

According to the present invention, by advantageously combining and using a toe position detector, treatment mechanism, support pressing mechanism, device base, and movement mechanism, the fatigue characteristics of a welded joint can be improved swiftly and rationally, thereby solving the above technical problems and economic problems advantageously.

For example, when using a robotic or other such automatic movement device, it is possible to simply instruct the overall direction for the weld bead. Functions for detecting and accurately tracking the strain of the toe of the weld bead become unnecessary. Construction of a treatment system by an extremely simple system becomes possible. This is extremely effective economically as well.

Further, when a human being performs impact treatment of a welded joint, the work requires frequent rest periods, but if the present invention is used, the only work during treatment is supervision, thus an increase in treatment efficiency can be expected.

Further, under conventional methods of directly impact treating the toe portion of the weld bead, it had been necessary to directly visually inspect whether the treatment was sufficient or not. Finding defects remaining in the toe of the weld bead had been difficult. However, with the present invention, it is sufficient to inspect only the treated part of a smooth base material metal, significantly reducing the load of inspection, as well as allowing quality control in treated weld zones to be carried out more rationally because the fault inspection of toes of weld bead can be separated.

Thus, according to the present invention, prevention of fatigue and shortening of the weld zone preparation steps and, further, an economic effect due to streamlining of inspection can be expected.

The invention claimed is:

1. An impact treatment method for improving welded joint fatigue characteristics, the welded joint having a weld line, the method comprising:

pressing an impact pin against the surface of a base metal material near a toe of a weld bead, moving the impact pin relative to the direction of the weld line, and applying a hammer peening treatment or ultrasonic impact treatment with the impact pin, wherein the impact pin has a tip curvature radius of ½ or less of the metal material thickness and the tip curvature radius is between 2 to 10 mm, and the hammer peening or ultrasonic impact treatment is applied on a surface of the base metal material to generate impact dents on the surface of the base metal material in a direction intersecting with the weld line direction within a range of 90% or more of the length of the weld line based on a toe of the weld line so that a distance from the toe of the weld bead to the center of the impact dents is no more than 2.5 times the tip curvature radius of the impact pin, and the impact pin does not contact weld metal during the impact treatment, wherein the impact pin produces residual plastic deformation on the surface of the base metal material by providing an impact dent groove having a depth satisfying all of the following: 0.1 to 2 mm, not more than the tip curvature radius of the impact pin, and 1/10 or less of the thickness of the metal material, and a width satisfying both of the following: 1.5 to 15 mm and five times or more of the impact dent groove depth.

* * * * *